United States Patent [19]

Hoyt

[11] 4,043,472

[45] Aug. 23, 1977

[54] LOAD BACK REST FOR LIFT TRUCK

[75] Inventor: Deryl R. Hoyt, Battle Creek, Mich.

[73] Assignee: Clark Equipment Company, Buchanan, Mich.

[21] Appl. No.: 720,285

[22] Filed: Sept. 3, 1976

Related U.S. Application Data

[63] Continuation-in-part of Ser. No. 636,501, Dec. 1, 1975, Pat. No. 3,995,891.

[51] Int. Cl.[2] ..... B66F 9/14

[52] U.S. Cl. ..... 214/750; 187/9 R; 214/674

[58] Field of Search ..... 214/730, 731, 674, 750, 214/672, 620, 145; 212/144; 29/160; 187/9 R; 403/382, 263, 186

[56] References Cited

U.S. PATENT DOCUMENTS

| | | | |
|---|---|---|---|
| 2,274,125 | 2/1942 | Carney | 29/160 |
| 2,350,875 | 6/1944 | Carney | 29/160 |
| 2,698,698 | 1/1955 | Smith et al. | 214/750 |
| 2,814,402 | 11/1957 | Schaefer | 214/750 |
| 3,224,081 | 12/1965 | Richter | 29/160 |
| 3,502,292 | 3/1970 | Yoder | 403/263 |
| 3,760,966 | 9/1973 | Jones, Jr. et al. | 214/750 |

*Primary Examiner*—Lawrence J. Oresky
*Attorney, Agent, or Firm*—John C. Wiessler

[57] ABSTRACT

A load back rest for industrial vehicles having a pair of spaced hollow multi-sided members. Each hollow member has a plurality of longitudinally spaced notches through one side in alignable and facing relation with corresponding notches in one side of the other hollow member so that a guard bar may be fitted in each facing pair of notches. Side rails connect the respective ends of the hollow members. The load back rest is supported from the fork carriage in a vertical plane at the front of the vehicle.

10 Claims, 5 Drawing Figures

LOAD BACK REST FOR LIFT TRUCK

This application is a continuation-in-part of my application Ser. No. 636,501, filed Dec. 1, 1975, now U.S. Pat. No. 3,995,891 which issued Dec. 7, 1976, common assignee.

BACKGROUND OF THE INVENTION

The field of art to which the invention relates includes load back rests for industrial vehicles.

It is standard practice to equip industrial lift trucks with load back rests to minimize the possibility of a load carried on the fork being dislodged in a rearward direction at a high mast elevation and falling backwards over the mast. Heretofore the guard bars or grille construction of such back rests have usually been of a welded design, i.e., vertical grille bars welded at both ends to vertically spaced parallel bars of the load back rest construction.

SUMMARY

This invention provides improvements in load back rests for industrial trucks in particular wherein vertically spaced, horizontally extending parallel bars form a generally rectangular guard structure with transversely spaced, vertically extending end plates, vertically extending and transversely extending grille bars being press fitted in transversely spaced notches formed in the upper and lower outer bars which comprise hollow multi-sided bar members. This structure provides a number of advantages over prior back rest structures including high rigidity and resistance to torsional forces combined with reduced weight, improved visibility through the back rest structure, improved appearance and faster assembly time partly as a result of minimizing the number of weldments, and lower costs.

It is a primary object of my invention to provide an improved load back rest structure.

DESCRIPTION OF THE PREFERRED EMBODIMENT

Figure 1:
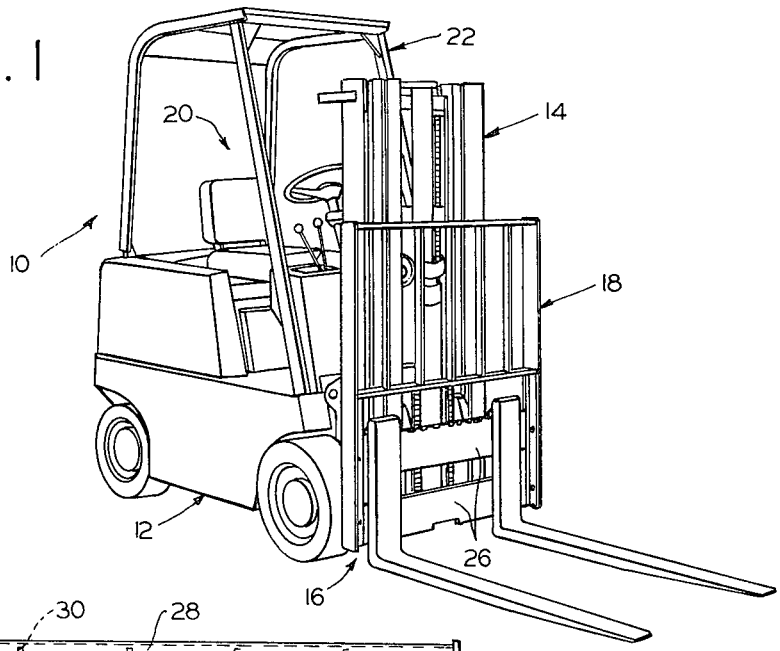
FIG. 1 is a perspective view of a lift truck which embodies my invention.

An industrial lift truck is indicated generally at numeral 10 which includes a body and frame mounted from a front drive axle and wheel assembly and a rear steer axle and wheel assembly, a tiltable telescopic mast structure and fork and fork carriage 16 having a load back rest of my invention supported therefrom and extending in a vertical plane above the fork carriage as indicated generally a numeral 18, an operator's station 20, and an overhead guard 22. The load back rest includes a pair of support legs 24 bolted to a pair of fork bars 26 of the fork carriage, and a rectangular frame structure which includes a pair of side plate members

27, a pair of upper and lower hollow multi-sided stuctural members 28 secured at the ends to plates 27, as by welding, and a plurality of grille bar members 30 which are connected to members 28 in a manner to be described.

As shown, each of the hollow structural members 28 is rectangular in cross section, although the sectional configuration may be varied so long as the vertical parallel sides of the members 28 as mounted in a load back rest are provided with openings in flat confronting sides for the reception of a plurality of the parallel grille bars 30 such that the strength and rigidity meet industry code safety requirements while effecting the functional and structural advantages of my load back rest design. Although square or rectangular hollow tube is preferred for reasons of cost, availability, rigidity and convenience in assembly, other configurations of members 28 may comprise, for example, a nonrectangular parallelogram or a member of trapezoidal cross section wherein the vertical parallel sides are top and bottom sides of the member.

Figure 5:
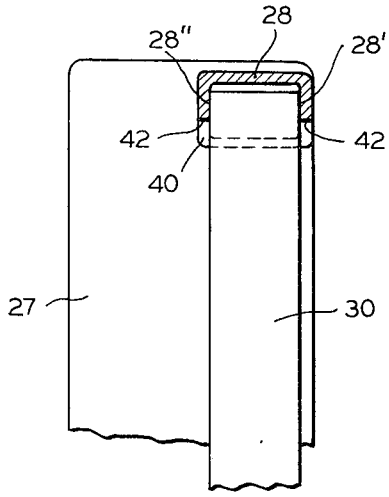
FIG. 5 is an enlarged view taken along lines 5—5 of FIG. 2.
Figure 3:
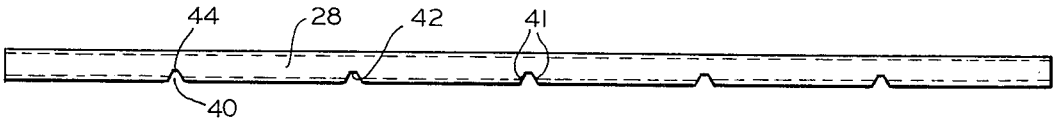
FIG. 3 is an enlarged front elevational view of one of the transverse hollow multi-sided members of the back rest.
Figure 4:
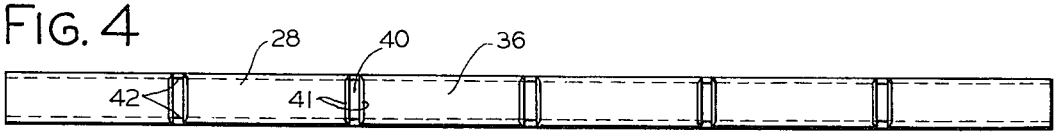
FIG. 4 is a front view of the member shown in FIG. 3.

Members 28 provide confronting sides 36 and 38 at the top and bottom, respectively, of the load rest, and each of which sides is formed of a plurality of equally spaced notches 40 which preferably are angled inwardly through the wall at the sides of each opening as shown at 41 to provide the notch formation as best shown in FIGS. 3, 4 and 5. The openings 40 are preferably formed by a broaching machine or by a gang mill which is adapted to form a plurality of such openings in a single pass. Each opening extends a small distance into the confronting sides of member 28 as shown at 42.

Figure 2:
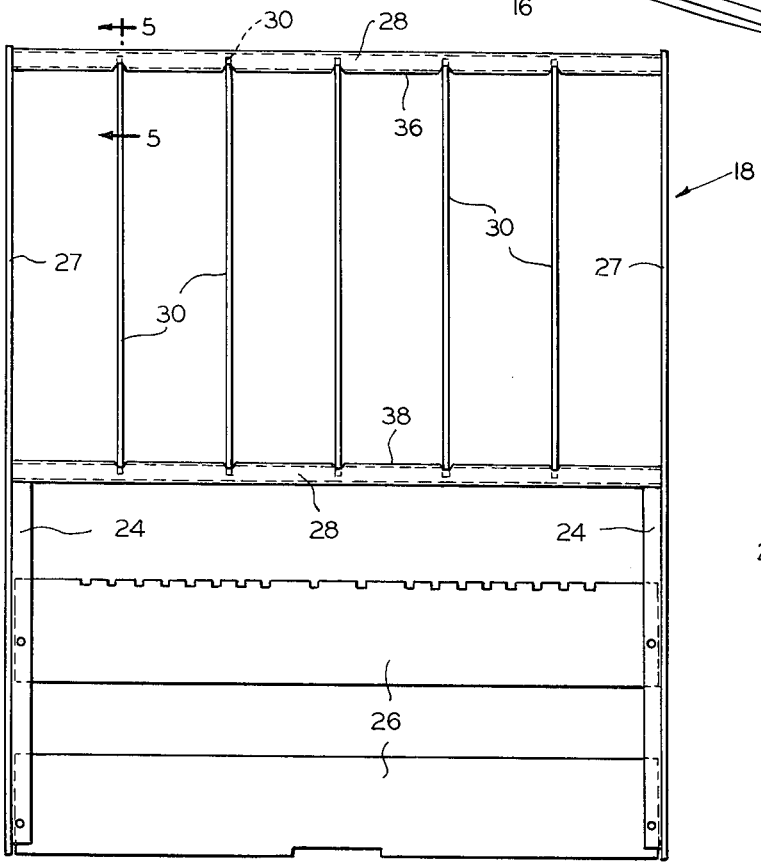
FIG. 2 is an enlarged front elevational view of the load back rest structure shown mounted on the lift truck in FIG. 1.

In assembling a load rest structure a fixture may be utilized in a hydraulic press, for example, in which the grille bars 30 are located in predetermined spaced and parallel relation, such as in FIG. 2, members 28 being actuated simultaneously in the press towards the respective ends of the grille bars in axial alignment with notches 40 so that bars 30 are readily guided into the notches between angled sides 41 and chamfers 42, thence being firmly pressed through each inner smaller opening 44. The press fit is not essential to the practice of my invention, although it is preferred in order to avoid the noise of rattling grille bars which would result if a press fit or other connection were not effected through angled sides 41.

The grille bars are therefore preferably pressed a substantial distance into hollow members 28 as shown in FIG. 2 so as to provide the known benefits in loading of a restrained beam type of anchor which theoretically doubles the resistance of bars 34 to permanent deflection as compared with a non-restrained end supported beam. That is, the front and rear surfaces of each end portion of each bar 34 are in contact with corresponding inside surfaces 28' and 28'' of each tube 28 when the grille bars are placed under a sufficient load so that resistance couples or a restrained beam effect is produced. To insure this effect no more than a small clearance should exist when the load rest is assembled between the adjacent front and rear suurfaces of members 28 and the corresponding end portions of the bars 30.

It will be appreciated that the same effect may be achieved in the use of members 28 which provide parallel front and rear sides, such as in a trapezoidal or non-right angle parallelogram section, whereby the notches 40 would appear in non-parallel confronting sides of the members 28 with a restrained beam effect as above described as between the parallel sides and the end portions of the guard bars. The desired effect would not be achieved, for example, of hollow tubular members 28 were utilized because then only essentially line contact between the ends of the grille bars and the tubular members would be effected at each notch. The resistance to permanent deflection of bars 30 in the structure as described above is approximately double the resistance in a structure in which bars 30 are merely welded at their ends, as is conventional, to the confronting sides of top and bottom solid end members, for example, the latter structure being that which has been heretofore commonly used in such load back rests.

A predetermined overall length of the back rest is established in assembling the bars 30 in members 28, following which the pair of solid side plate members 27 are secured, as by welding, between the respective ends of members 28, the structure being then ready for attachment to pairs of legs 24 for connection to fork bars 26. Either cold or hot rolled grille bars may be used with square cut ends.

Certain other advantages of the design are set forth in my above co-pending application Ser. No. 636,501.

It will be apparent to those skilled in the art that various changes in the structure and relative arrangement of parts may be made without necessarily departing from the scope of my invention. Accordingly, I intend to cover by the appended claims all such modifications which fall within the scope of my invention.

I claim:

1. In a lift truck having a load back rest connected to an elevatable fork carriage and extending in a generally vertical plane above the carriage, a back rest structure generally rectangular in configuration comprising a pair of vertically spaced multi-sided hollow structural members having inner sides confronting, a plurality of openings in one inner side spaced longitudinally thereof and substantially aligned with similar openings in the other inner side, a grille bar extending through each confronting pair of openings and into the interiors of both hollow structural members in such a manner as to provide a plurality of restrained beams when said beams deflect under load.

2. A load back rest as claimed in claim 1 wherein each of said hollow structural members provides substantially parallel front and rear sides which are adapted to provide a resistance force couple at the end portion of each grille bar inside of the hollow member.

3. A load back rest as claimed in claim 1 wherein said openings are formed so as to provide with said grille bar a press fit whereby to prevent grille bar rattle during vehicle travel.

4. A load back rest as claimed in claim 1 wherein said back rest structure is assembled by locating the grille bars in predetermined spaced positions in a press and actuating simultaneously the openings of said hollow structural members into a pressed relation with the end portions of the grille bars.

5. A load back rest as claimed in claim 1 wherein said hollow structural members tend to maximize torsional resistance to eccentric loading on the back rest structure such as at a corner portion thereof.

6. A load back rest as claimed in claim 1 wherein said openings are machined in predetermined locations in the structural members to provide consistent quality control of the configuration of the back rest structure and of the spacing and location of the grille bars.

7. A load back rest structure as claimed in claim 1 wherein the hollow structural members and grille bars are assembled without weldments.

8. A load back rest as claimed in claim 6 wherein said openings are formed in multiple groups by a broaching machine.

9. A load back rest as claimed in claim 6 wherein said openings are formed in multiple groups by a gang mill.

10. A load back rest as claimed in claim 6 wherein said openings are formed to provide inwardly converging openings in the wall of the hollow structural member.

* * * * *